United States Patent [19]

McCorsley, III

[11] 4,261,943

[45] Apr. 14, 1981

[54] PROCESS FOR SURFACE TREATING CELLULOSE PRODUCTS

[75] Inventor: Clarence C. McCorsley, III, Asheville, N.C.

[73] Assignee: Akzona Incorporated, Asheville, N.C.

[21] Appl. No.: 54,074

[22] Filed: Jul. 2, 1979

Related U.S. Application Data

[63] Continuation of Ser. No. 847,200, Oct. 31, 1977, abandoned.

[51] Int. Cl.[3] ..... B29G 5/00

[52] U.S. Cl. ..... 264/136; 264/143; 264/181; 264/187; 264/203; 264/210.3; 264/210.8

[58] Field of Search ..... 264/181, 180, 207, 187, 264/203, 136, 210.4, 143, 210.3, 210.8; 106/186

[56] References Cited

U.S. PATENT DOCUMENTS

| | | | |
|---|---|---|---|
| 1,685,640 | 9/1928 | Leaver | 264/181 |
| 2,179,181 | 11/1939 | Graenacher et al. | 106/40 |
| 2,318,679 | 5/1943 | Dreyfus | 528/335 |
| 2,323,383 | 7/1943 | Dreyfus | 264/176 F |
| 2,425,782 | 8/1947 | Bludworth et al. | 264/206 |
| 2,988,418 | 6/1961 | Finlayson et al. | 264/203 |
| 3,410,940 | 11/1968 | Henderson et al. | 264/182 |
| 3,415,922 | 12/1968 | Carter et al. | 264/203 |
| 3,447,939 | 6/1969 | Johnson | 106/135 |
| 3,508,941 | 4/1970 | Johnson | 106/126 |
| 3,842,151 | 10/1974 | Stoy et al. | 284/203 |
| 4,142,913 | 3/1979 | McCorsley et al. | 106/186 |
| 4,144,080 | 3/1979 | McCorsley et al. | 106/186 |

*Primary Examiner*—Jay H. Woo

*Attorney, Agent, or Firm*—Francis W. Young; Jack H. Hall

[57] ABSTRACT

This invention relates to a process for treating the surface of cellulosic shaped products such as fibers, films filaments, yarns and the like, formed from a spinning dope of a solution of cellulose in amine oxide, by applying to the surface of the product a nonsolvent liquid that will reduce the solvent action of the amine oxide for cellulose at the surface of the product.

26 Claims, 8 Drawing Figures

PROCESS FOR SURFACE TREATING CELLULOSE PRODUCTS

This is a continuation of application Ser. No. 847,200, filed Oct. 31, 1977, now abandoned.

In the process of forming filaments from an extrusion of a cellulose spinning dope, there arises the problem of surface tacking and/or fusion of filaments as they are brought in contact with each other at a point of collection. Such tacking and/or fusion of the filaments contributes to further difficulties in the continuing processing of the filaments for their formation into yarn. Of interest in the prior art in the U.S. Patent to Blades No. 3,767,756 which discloses a process for the spinning of filaments from a polyamide spinning dope and passing the filaments through a layer of inert noncoagulating fluid and into a coagulating bath before the filaments are brought together for further processing. Also, the U.S. Patent to Morgan No. 3,414,645 is directed to a process for spinning wholly aromatic polyamide fibers in which the filaments after extrusion are passed through gaseous medium for a short distance to evaporate a small amount of the solvent before the fibers enter a coagulation bath, after which they are washed and stretched. None of the art, however, provides for a surface treatment of filaments formed from a solution of cellulose in amine oxide with a surface coating of a nonsolvent liquid that inhibits the fusing and/or tacking of the filaments together when they are collected.

This invention contemplates such a new process and provides for surface treating filaments extruded from spinning dope of a solution of cellulose dissolved in amine oxide, by applying to the surface of the extruded filament, immediately after extrusion, a solution of a nonsolvent liquid capable of rendering the amine oxide inactive as to its ability to form solutions with cellulose and thus reduce the tendency of tacking and/or fusion of filaments so that when they are collected together, surface tacking or fusing of adjacent filaments is substantially reduced.

The coating of the filaments with the nonsolvent may be accomplished by passing them immediately after extrusion and before they are collected together into contact with a surface that contains a continuous supply of a liquid which is nonsolvent for cellulose so that the surface of the filaments is continually coated with the nonsolvent liquid.

In addition to surface coating of the filaments with the nonsolvent liquid, the surface of the filaments can be passed through a chamber having nonsolvent vapor laden atmosphere, such as a fog of minute particles or droplets of nonsolvent liquid, so that particles of the nonsolvent liquid are deposited on the surface of the filaments. In order to increase the deposition of the liquid particles on the surface of the extruded filaments an electrostatic charge can be placed on the filaments such that the surface of the filaments has a polarity opposite to that of the particles in the vapor laden atmosphere thereby increasing the attraction of the particles to the surface of the filaments.

Another method by which the extruded filaments may be coated with the nonsolvent liquid is by passing the filaments as extruded through a vapor layer of nonsolvent liquid for a very short period of time and then into a tank which contains the nonsolvent liquid, and then bringing the coated filaments together.

Still another method for coating the filaments with nonsolvent liquid is by extrusion of the filaments through a spinneret in which a plurality of jet openings, communicating with a chamber providing a continuous supply of nonsolvent liquid, are positioned adjacent to the spinneret orifices. By passing a nonsolvent liquid through the jet openings in the spinneret as the filaments are extruded through the spinneret orifices, the surface of each filament is immediately, or after a very short interval of contact with air in a gap between the spinneret orifices and the nonsolvent liquid, coated with nonsolvent liquid, thus preventing tacking or fusing of filaments when they are brought together.

The extruded filaments of this invention can be subjected to a drawing operation during the application of the nonsolvent with a major portion of the drawing of the filaments to induce improved physical properties therein being accomplished before the nonsolvent liquid coated filaments are collected together. Extruded filaments treated in accordance with the process of this invention, after being coated with the nonsolvent liquid, can be handled by conventional wet spinning equipment.

These and other objects will become apparent from the following description of the preferred embodiments and examples and the accompanying drawings which illustrate diagrammatically an apparatus which may be used to practice the process of this invention, in which drawings.

Figure 7:
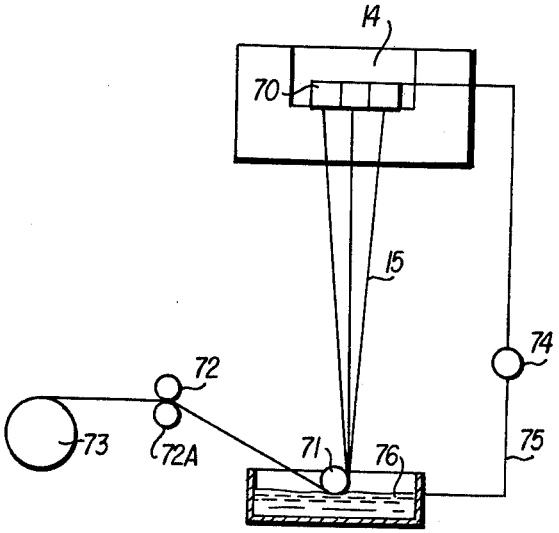
Figure 6:
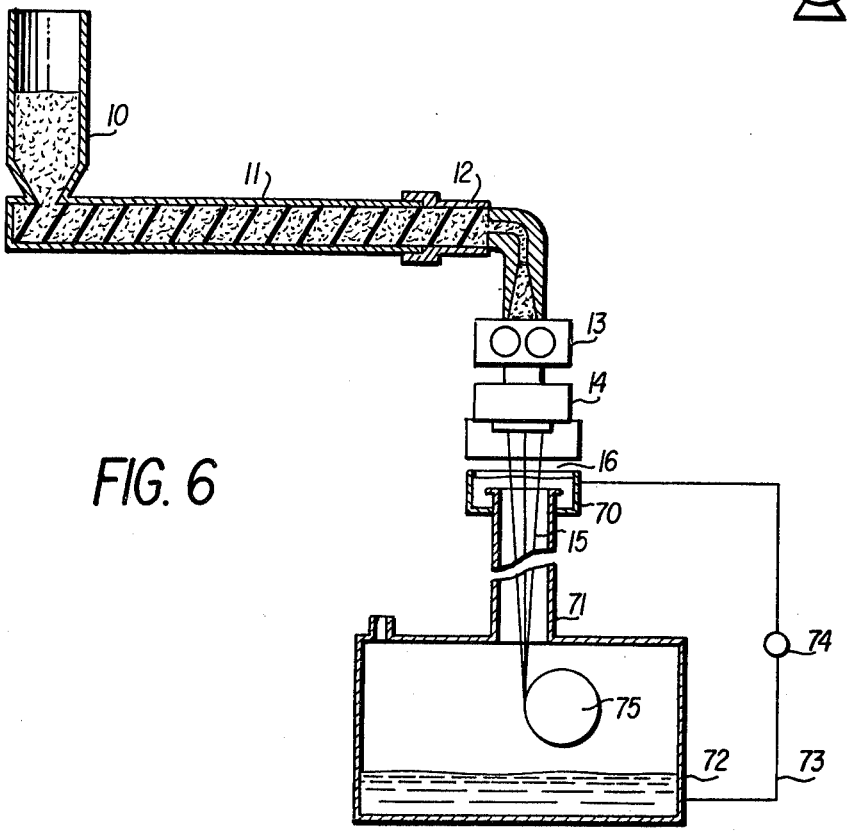

FIG. 6 is a schematic view of still another embodiment of the invention showing an apparatus for applying nonsolvent liquid to the surface of filaments as the filaments pass through a vertical tube with nonsolvent liquid flowing through it; and FIG. 7 is a schematic view of still a further embodiment of the invention showing nonsolvent liquid flowing through jet openings in a spinneret plate adjacent to spinneret orifices.

Figure 8:
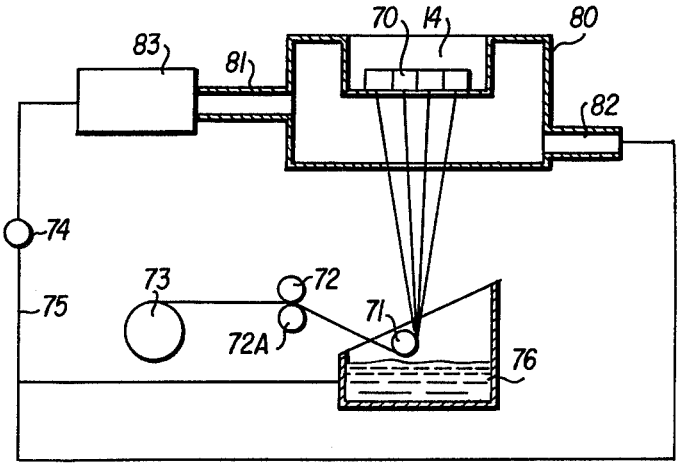

FIG. 8 is a schematic view of still another embodiment of the invention showing an apparatus for applying nonsolvent liquid to the surface of filaments passing through a chamber containing foamed nonsolvent liquid.

Figure 1:
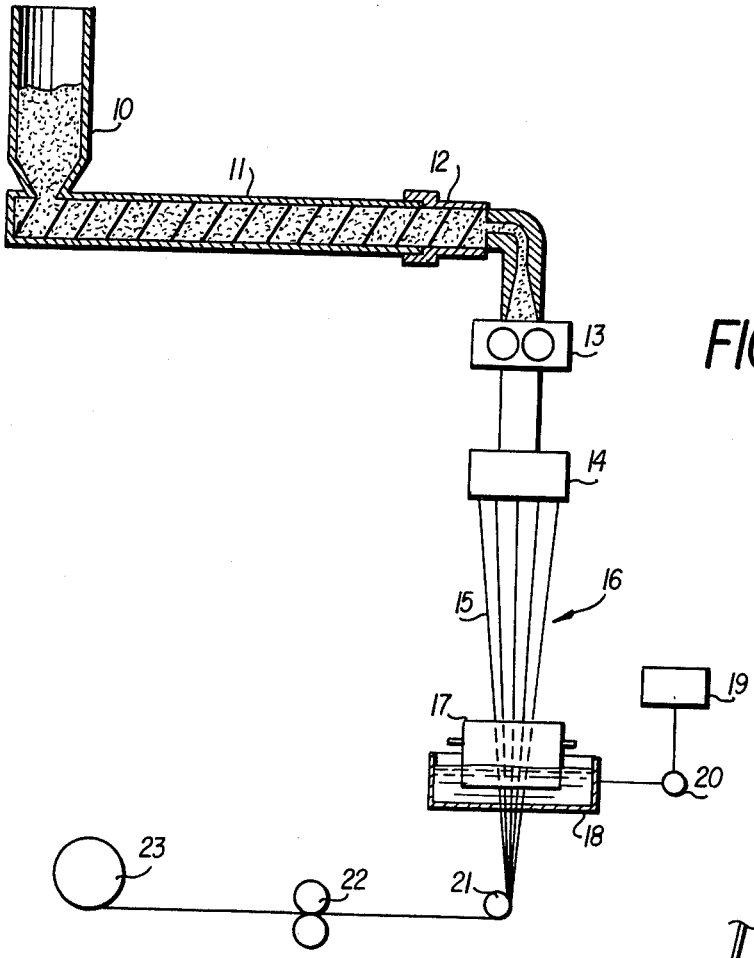
FIG. 1 is a schematic view of an apparatus for carrying out the process of the invention, in which a nonsolvent liquid is applied to the filaments by a roller applicator.

In FIG. 1 is illustrated the applying of a nonsolvent liquid to the surface of a spun filament formed from cellulose dissolved in amine oxide in accordance with this invention. The solution of cellulose in amine oxide can be made in a conventional manner, e.g., by dissolving cellulose in an amine oxide solution in a heated tank, preferably under pressure or by any other means. For example, as illustrated, solid cellulose sheets impregnated with the amine oxide solvent are added to a hopper and fed by an extruder 11 through a die port 12 to a metering device 13 whereby the cellulose becomes completely dissolved in the amine oxide at the elevated temperature and pressure in the extruder, then extruded or spun through a spinneret 14.

The use of an extruder to dissolve amine oxide-impregnated cellulose is more fully described in Applicant's copending application, Ser. No. 819,082, filed July 26, 1977, now U.S. Pat. No. 4,144,080, which is hereby incorporated herein in its entirety.

The cellulose solution is continuously extruded from the spinneret 14 to form a plurality of filaments 15 which, due to the amount of amine oxide solvent present in their composition, must be carefully spaced from each other so that sticking or fusion of the filaments does not occur. To accomplish this, the spinneret orifices are patterned so that the extruded fibers remain spaced from one another until they are collected together for further processing. The filaments 15 pass downward through a small air space 16 in which some of the volatile solvent from the surface of the filaments is removed. All filaments are extruded so that in their downward travel they contact a portion of the surface of an applicator roll 17 which can be driven at any speed in either direction, but preferably rotates in the same direction and at a peripheral speed less than the linear speed of the filaments to reduce the tendency of the filaments to fuse together. The rotating applicator roll 17 is positioned with its bottom portion immersed in a trough 18 containing the nonsolvent liquid so that its surface maintains a constant supply of nonsolvent liquid for the coating of the filaments passing against its surface. Nonsolvent liquid is supplied to trough 18 from a supply tank 19 by a pump 20 to maintain a constant supply of nonsolvent liquid in trough 18. It will be appreciated that the surface of the applicator roll must be formed from a material that is capable of the proper degree of liquid pick-up so that its surface continuously presents an amount of liquid that will effectively coat the surface of the filaments when they are brought into contact with the surface of the applicator roll.

After the coating of the filaments with the nonsolvent liquid, they are brought together and passed around a turning godet roll 21 and then between feed rolls 22, 22A to a take-up roll 23. The filaments before collection and passing over the godet 21 have their surface coated with a thin film of a nonsolvent which substantially eliminates tacking and/or fusing of adjacent filaments.

Advantageously, the surface of the roller applicator 17 may have concentric spaced surface grooves 24 positioned so that individual filaments 15 can be guided during their contact with applicator roll 17. It will be appreciated that the individual grooves 24 not only assist in maintaining filaments at a desired spaced interval from each other but also provide in the grooves a pool of nonsolvent liquid which assists in the efficiency of application of the nonsolvent liquid to the surface of the filaments, requiring less contact time in which the surface of the filaments must be in contact with the surface of the applicator roll 17 (see FIG. 2).

It will be appreciated that in the roller application of the nonsolvent, the filaments can be directed so that the surface of the spaced filaments just kiss the surface of the roller applicator or can be brought into contact so that they maintain a contact with the roller surface over a segment of the surface. The amount of contact, of course, will depend on the ability of the surface of the applicator roll to pick up nonsolvent liquid and impart it to the surface of the filaments. It is important that the applicator roll have a pick-up surface that will not abrade or break the thread line while possessing the ability to pick up sufficient liquid and deposit it effectively on the surface of the filament during the period of contact.

Figure 2:
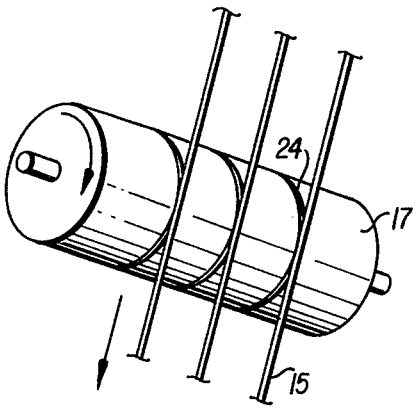
FIG. 2 is a schematic view of a modification of the roller applicator in FIG. 1 showing spaced concentric grooves with filaments contacting the surface of the grooves in the surface of the roller applicator.

The roller applicator may be rotated in either direction, but when the roller applicator 17 is rotated in the same direction as the filament, as illustrated in FIG. 2, at the point of tangency where the filament first contacts the surface, the peripheral speed of the roller preferably should be less than the linear speed of the filament. In either case, the peripheral speed of the roller should be not less than a speed that will carry a sufficient amount of nonsolvent liquid to coat the filaments.

It will also be appreciated that the nonsolvent liquid can be applied to the roller applicator surface as by other means than by immersion of the applicator such as by spray nozzles or a doctor blade in which the liquid can be sprayed or doctored onto the surface of the roller to provide the desired amount of liquid to be applied to the surface of the filaments.

Figure 3:
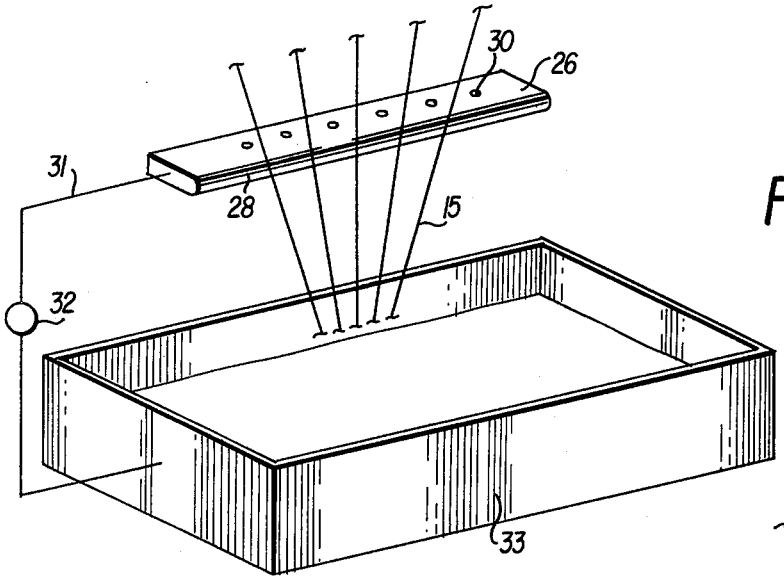
FIG. 3 is a schematic view of a modification of FIG. 1 in which the nonsolvent liquid is applied to the filaments by contact with the edge of a plate surface supporting a film of nonsolvent liquid.

Another method of contact application of the nonsolvent liquid to the surface of the filaments is shown in FIG. 3 in which the filaments 15 are brought into contact with a curved edge 28 of an applicator plate 26 which has a downwardly tilted surface that terminates in the curved edge 28. Positioned in the surface of the plate applicator is a series of spaced outlets 30 through which continuously flows nonsolvent liquid that passes over the surface of the plates and then passes over the curved edge so that the filaments 15 continuously contact the edge 28 where they are coated with the nonsolvent liquid.

The outlets 30 are operatively connected to a supply line 31 through which the nonsolvent liquid is continuously supplied to the outlets by a pump 32 from a supply source 33 located under the applicator plate 26. The nonsolvent liquid passing over edge 28 is collected in supply source 33 where it is recycled to the plate 26.

Figure 4:
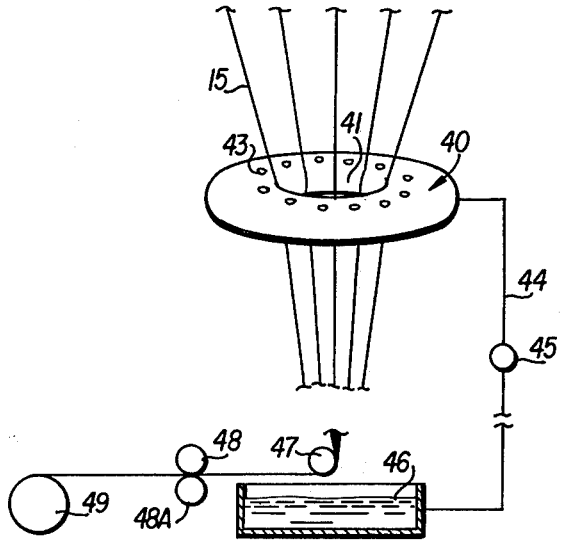
FIG. 4 is a schematic view of a modification of FIG. 3 in which the plate has an annular-shaped contact surface containing a film of a nonsolvent liquid.

Another method of application of a nonsolvent liquid to the surface of the extruded filaments is shown in FIG. 4 in which a donut-shaped applicator surface 40 is used to apply the nonsolvent liquid to the extruded filaments. The filaments 15 are passed in contact with inner annular surface 41. The top of the donut-shaped applicator 40 has a series of spaced holes 43 which are operatively connected to a supply line 44 having a metering pump 45 which supplies a constant flow of nonsolvent liquid to the top surface of the donut-shaped applicator from a supply source 46, which is positioned under a godet roll 47 which is the point of collection of the filaments that have been coated with the liquid. The collected filaments from godet roll 47 are turned and passed through feed rolls 48, 48A and then to take-up roll 49. The liquid after flowing over the inner annular surface 41 is collected at the supply source. The position of the holes 43 is on the downward side of the top of the curved surface that forms the inner annular surface so that the liquid will flow towards and over this surface to supply the required amount of nonsolvent liquid to the filaments. The direction of the liquid could be reversed so the liquid travels to the outside edge of the donut, and the filaments are maintained in contact with the outside, rounded edge of the donut. Similarly, a flat horizontal circular plate with rounded edges can be used for applying nonsolvent liquid to the surface of the filaments. It will be appreciated that in all plate applicator constructions, the extruded filaments contact the edge of the plate and the spinneret orifices are patterned so that the filaments will be extruded so that their thread line will not make contact with each other until after the nonsolvent liquid has been applied.

It also will be appreciated that the spinning solution must have sufficient viscosity so that filaments formed from it will be able to withstand any forces that may be present during the period of contact with the applicator surface so that there is no breaking of the thread line. One skilled in spinning will be able to adjust the conditions, i.e., spinning velocity, the position of the applicator and the take-up speed, concentration of amine oxide in the spin bath to obtain a fiber of the desired denier and physical properties.

Figure 5:
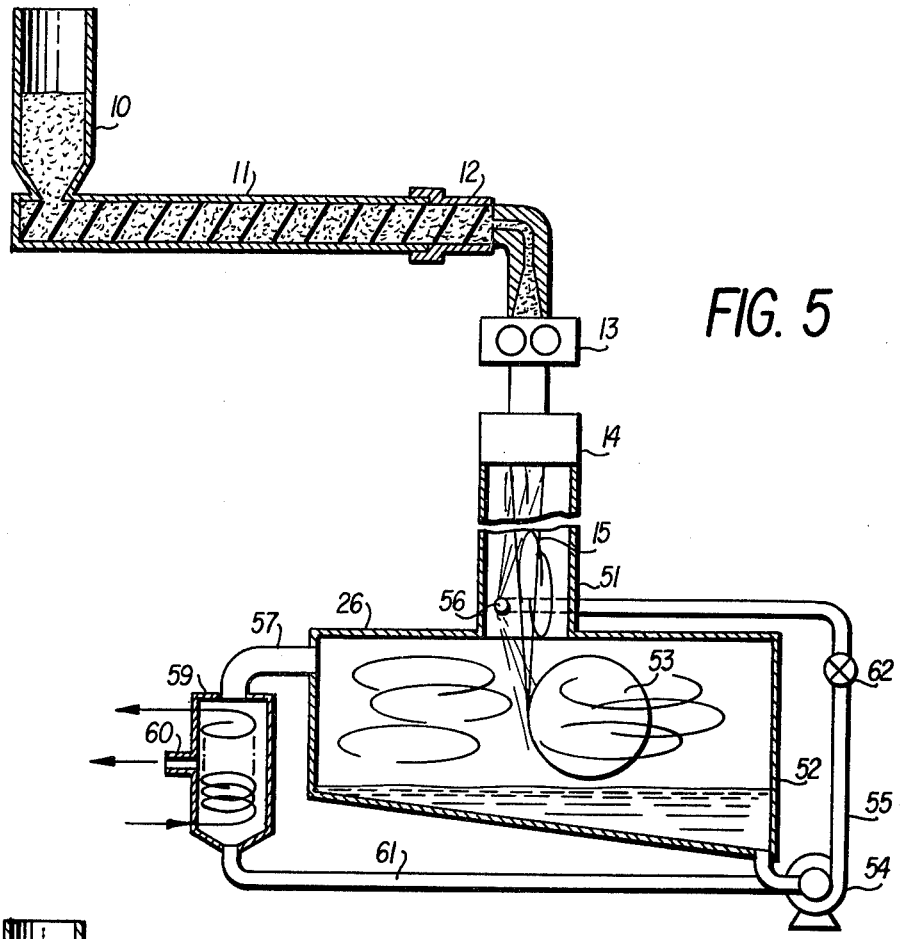
FIG. 5 is a schematic view of a further embodiment of the invention showing an apparatus for applying nonsolvent liquid to the surface of the filaments passing through a chamber containing aerosolized or atomized nonsolvent particles.

FIG. 5 is another embodiment of the process of the invention. In this embodiment a hopper 10 supplies solid cellulose and amine oxide solvent or cellulose impregnated with amine oxide solvent to an extruder 11 which mixes the materials and where a solution is formed as previously mentioned and conveyed to a metering device 13. The metering device 13, which may be a pump, conveys a metered amount of the solution through spinneret 14 to form continuously extruded filaments 15. The filaments 15 pass from the spinneret into the top of a fog chamber 51 containing an atmosphere laden with particles of nonsolvent liquid. The filaments pass through the fog chamber 51 into a lower chamber 52 where they are collected on a take-up roll 53 or further processed, e.g., cut into staple, washed, etc.

During their passage through the fog chamber, the particles of nonsolvent liquid are condensed onto the surface of the filaments to inactivate the solvent so as to cause precipitation of the cellulose on the surface of the filaments, thus eliminating the tackiness at the surface and tendency of filaments to stick to each other. Nonsolvent liquid is collected in the lower chamber 52 and is recirculated by a pump means 54 through a liquid line 55 into the chamber 51 through an atomizing nozzle 56 positioned in the chamber 51.

Positioned in the lower chamber 52 is an outlet opening 57 for removal of air laden with nonsolvent liquid which is passed through a condenser means 59 with the air free of nonsolvent liquid exiting through opening 60 to the atmosphere and the condensed nonsolvent liquid passing through line 61 to pump means 54 where it is recycled to atomizing nozzle 56.

Advantageously, the fog chamber 51 may have more than one atomizing nozzle 56 spaced so that the fog chamber is provided with a substantially uniform atmosphere laden with nonsolvent liquid particles to aid in covering of the surface of the filaments with nonsolvent liquid as the filaments travel from the spinneret to their point of collection on the take-up roll.

It will be appreciated that the aerosolized or atomized nonsolvent particles must be rather small and must be introduced into the fog producing chamber in a manner so that there is a minimum of turbulance to prevent the filaments passing downwardly through the atomized particles from being swayed from their normal path. Also, the concentration of suspended nonsolvent particles in the atmosphere must be sufficient so that the surface of all the filaments passing through the chamber 51 have atomized particles of nonsolvent deposited during substantially all of their travel through the chamber 51. Advantageously, the extruded filaments may be electrically charged so that the surface of the filament will attract suspended particles of liquid. Suitable control means 62 can be provided to assure that the pressure in line 55 is maintained so that the proper quantity of nonsolvent liquid is passed through the nozzles to produce the desired atmosphere.

FIG. 6 of the drawings shows a still further embodiment of the process of this invention. In this embodiment the filaments 15 are extruded from spinneret 14 through a small air space 16 and into an immersion tank 70 containing nonsolvent liquid. Exiting from the bottom of immersion tank 70 is a downwardly extended tube 71 which exits into a lower tank 72. Connected to the bottom portion of tank 72 is a liquid supply line 73 which by pump means 74 transfers nonsolvent liquid from lower tank 72 to immersion tank 70. The pump means 74 maintains a constant flow of nonsolvent from the lower tank 72 to immersion tank 70 to maintain the level in the immersion tank constant, thus replacing nonsolvent liquid that flows downward through vertical tube 71.

The filaments pass through the nonsolvent liquid in the immersion tank and the extended tube 71 and passed over cutting rolls 75 where they are cut into staple fibers which are collected and removed for further fiber processing.

In air space 16 is maintained a constant vapor layer which may consist of an inert gas or a nonsolvent vapor or fog between the spinneret and the surface of the liquid in the immersion tank 70. It has been found that excellent results are obtained when the gaseous or vapor layer through which the filaments pass is from about 0.5 cm to greater than 10 cm in length.

FIG. 7 of the drawings illustrates another embodiment of the invention in which the nonsolvent liquid is sprayed directly into the downward path of extruded filaments as they are formed. In this process the nonsolvent liquid is sprayed from a plurality of openings 70 in the face of the spinneret 14 positioned adjacent to spinneret orifices. The filaments covered with nonsolvent liquid travel downwardly to a godet roll 71 where the filaments are collected and turned and pass through a pair of feed rolls 72, 72A to a take-up roll 73.

The opening 70 in the spinneret communicates with a supply of nonsolvent liquid which is forced through the opening by pump 74 through a supply line 75 from a supply of nonsolvent liquid in a container 76. The sprayed nonsolvent liquid which does not adhere to the surface of the filaments falls by gravity into the container 76. The pump 74 maintains sufficient pressure in the liquid line 75 to assure that the proper quantity of nonsolvent liquid is sprayed through the opening 70 to provide jets of liquid that will effectively cover the surface of the extruded filaments before they are brought together.

FIG. 8 is similar to FIG. 7 and the same numerals are used for like features. In FIG. 8, the filaments are extruded or spun through the spinneret 14 into a chamber 80 having an inlet 81 and an outlet 82 for the introduction of the nonsolvent and a foamy carrier, such as a surfactant, which can be foamed easily in mixing vessel 83 by mixing with the non-solvent liquid and can easily be separated from the nonsolvent liquid. The foamy carrier provides for rapid and complete contact of the filament as it leaves the spinneret by the nonsolvent liquid. The preferred foamy carrier surfactant may be a nonionic surfactant such as ethoxylated fatty alcohols, ethoxylated fatty acids or ethoxylated(s) alkyl phenols or long-chain amine oxides, e.g., dimethyl coco amine oxide, N-coco morpholine oxide.

During the application of the nonsolvent, the filaments can be drawn with a draw ratio of from 1:1 to about 1:100 with a major portion of the filament drawing being performed close to the spinneret and well before they are collected together.

It will be appreciated that the filaments treated in accordance with the process of this invention can be passed directly to a cutting roll to form staple fiber which then is collected for further fiber processing. It has been found that the very good results were obtained when filaments were spun at linear speeds up to 300 meters per minute and that spinning speeds measured at the take-up roll of about 1000 meters per minute or even higher can be used without substantial sticking or fusion of the filaments when collected. However, with a conventional bath, spinning speeds greater than about 200 meters per minute cannot be attained.

It will also be appreciated that any amine oxide composition that will form a solution with cellulose and is compatible with water may be used. Exemplary of some amine oxides are N,N-dimethylcyclohexylamine oxide, dimethylethanol amine oxide, N-methylmorpholine oxide, dimethyl benzylamine oxide, and the like. The use of amine oxides in processes for dissolving cellulose is disclosed in the U.S. Patents to Johnson Nos. 3,447,939 and 3,508,941 which particularly disclose processes for dissolving cellulose in tertiary amine oxides. Also, the U.S. Patent to Graenacher No. 2,179,181 discloses tertiary amines containing 14 or less carbon atoms and discloses that the oxides may be trialkyl amine or an alkylcycloaliphatic tertiary amine. In all cases, however, it has been determined by Applicant's co-workers that the amine oxides require the presence of a critical amount of water in order to dissolve cellulose.

The composition of the spinning solution of this invention covers solutions containing from about 1% to about 40% by weight of cellulose, from about 98% to about 50% by weight amine oxide and from about 20% to about 1% by weight of water.

The nonsolvent liquid which has been found to effectively coat the fibers can be water or any suitable aprotic organic liquid which does not react with amine oxide, and is a nonsolvent for cellulose. For example, alcohols having from 1 to 5 carbon atoms may be employed as the nonsolvent, such as methyl alcohol, n-propyl alcohol, isopropyl alcohol, butanol, and the like. Also toluene, xylene, or the like may be employed as the nonsolvent liquid. It has been found that varying amounts of the amine oxide can be incorporated in the nonsolvent liquid; however, the concentration of the amine oxide must be low enough so the character of the liquid remains nonsolvent to cellulose. In addition, it will be appreciated that mixtures of the compounds that are nonsolvent to cellulose mentioned above may be used as the nonsolvent liquid.

The following examples are exemplary of the processes of this invention and show the conditions and results of applying a coating of a nonsolvent liquid to the surface of extruded filaments before they are brought together.

EXAMPLE I

In this Example, the extruded filaments were treated in accordance with the process of this invention by contacting the surface of the filament against a surface containing nonsolvent liquid.

A spinneret 60 mm in diameter was prepared having thirteen 250-micron($\mu$) holes in two rows, one row had six holes and the other row seven holes, with the rows staggered, the centerline of each row of holes being $\frac{1}{8}$ inch apart and the holes in each row being $\frac{1}{4}$ inch apart. A roller applicator was used as the means for applying the nonsolvent liquid to the filaments and was placed at a distance of 27 cm from the spinneret face with the spinneret hole rows running parallel to the turning axis of the roller applicator. The point of collection was a godet roll 91 cm from the face of the spinneret.

A spinning solution containing 23.8% cellulose, 65.7% amine oxide, and 10.5% $H_2O$ was used with the extruding temperature at 120° C. at the spinneret level. An extrusion velocity of 18.76 feet per minute was maintained with a take-up speed of 621 feet per minute, providing a draw ratio of 33:1. The extruded filaments were passed over a roller applicator turning at a periphery speed of approximately the speed of the filaments in contact with the roller applicator. The roller applicator was immersed in water thus providing a water coating to the surface of the filaments by surface pick-up of the applicator roll. The filaments were collected over the godet roll and passed onto a spool and the resultant yarn cut in $1\frac{3}{4}$ inch lengths, washed, dried and carded. The treated yarn carded very well showing that tacking or fusing of fibers together was substantially eliminated by the surface treatment of the fibers with the nonsolvent liquid.

EXAMPLE II

The same spinning solution and process conditions as set forth in Example I can be used to make filaments according to the process of the invention except that methanol replaces the nonsolvent liquid applied to the surface of the filaments by the roller applicator.

The resulting filaments are then cut in $1\frac{3}{4}$ inch lengths, washed and dried.

EXAMPLE III

In this Example, a spinning solution similar to that of the above Examples was extruded in the spinning apparatus shown in FIG. 6. After the polymer passes through a die 12 equipped with a port for pressure or temperature sensing, the polymer is fed to the spinneret 14 by a metering pump 13 having a capacity of 0.584 cc./revolution. The metering pump 13 is surrounded by a block which can be heated by fluid flowing therethrough. The extruded filaments were directed downwardly with the nonsolvent liquid flowing through the tube 15 onto the take-up reel 75.

EXAMPLE IV

In this Example, the same spinning solution as set forth in Example I was used, the extruded filaments were treated by passing the filaments through a fluid bath of nonsolvent liquid. The filaments extruded were passed through a chamber containing an atmosphere saturated with atomized water particles. The filaments were extruded at a velocity of 4.65 meters per minute (m/min.) and a take-up speed of 207 m/min. giving a draw ratio of 44.6:1 with the filaments passing through a chamber containing the atomized water particles for more than 75% of their travel before they were collected. The filaments coated with water upon exiting from the chamber were collected together and taken up on a roll. The fibers produced were then cut to form staple fibers of 1¾ inch lengths, washed and dried.

The dried fibers carded very well showing that the tacking or fusing of fibers during processing was substantially eliminated. The tenacity of the fibers was 2.03 g/denier; the denier was 3.4, elongation was 9.4%.

It is believed that the coating of the filaments with nonsolvent liquid immediately after they are extruded helps to retain the orientation developed in the yarn by the drawing and also adds handling strength to the yarn by additional cooling and removal of some of the amine oxide from the solution.

Although the invention is described in detail for the purpose of illustration, it is to be understood that such detail is solely for that purpose and that variations can be made therein by those skilled in the art without departing from the spirit and scope of the invention except as it may be limited by the claims.

The embodiments of the invention in which an exclusive property or privilege is claimed are defined as follows:

1. A process for inhibiting surface adhesion of adjacent filaments formed from a spinning of cellulose in amine oxide comprising: continuously extruding said spinning solution in an air space to form spaced adjacently positioned filaments and, before said filaments are brought into contact with each other, applying to the surface of said filaments a continuous coating of a nonsolvent liquid that will reduce the solvent action of the amine oxide for cellulose at the surface of the filaments.

2. The process of claim 1 in which said spinning solution is a solution of cellulose in amine oxide comprising from about 1% to about 40% by weight cellulose, from about 98% to about 50% by weight amine oxide, and from about 20% to about 1% water.

3. The process of claim 1 in which the nonsolvent liquid that will reduce the solvent action of the amine oxide for cellulose is a sterically unhindered aprotic compound or mixture thereof selected from the group consisting of low molecular weight alcohols, organic acids, dilute mineral acids and water.

4. The process of claim 1 in which the nonsolvent liquid that will reduce the solvent action of the amine oxide for cellulose is water.

5. The process of claim 3 in which the aprotic compounds are alcohols having from one to about five carbon atoms.

6. The process of claim 1 in which the filaments are subjected to drawing immediately after extrusion to improve their physical properties with at least the major portion of the draw of the filaments being done before said filaments are brought together.

7. The process of claim 6 in which the ratio of draw of said filaments is from 1:1 to about 1:100.

8. The process of claim 1 in which the filaments after said nonsolvent liquid has been applied are collected and passed over a cutter roll to produce cut staple fibers.

9. The process of claim 1 in which the filaments after said nonsolvent liquid has been applied are collected onto a take-up roll.

10. The process of claim 1 in which the surface of said filaments is coated with said nonsolvent liquid by contact with an applicator surface containing a film of the nonsolvent liquid.

11. The process of claim 10 in which the applicator surface is a rotating cylinder with a nonsolvent liquid continuously supplied to its surface.

12. The process of claim 11 in which the surface of said rotating cylinder has a peripheral speed substantially less than the linear speed of said filaments.

13. The process of claim 11 in which the surface of said rotating cylinder has a plurality of spaced grooves encircling its peripheral surface with each filament riding in one of said grooves for a portion of the periphery continuously in contact with the nonsolvent liquid in the grooves.

14. The process of claim 10 in which the applicator surface is a stationary flat plat having a curved edge over which continuously flows the nonsolvent liquid with the filaments contacting the nonsolvent liquid as it flows over the edge of the plate.

15. The process of claim 10 in which the applicator surface is of stationary circular construction having downwardly positioned curved edges with nonsolvent liquid continuously flowing over said edges and with said filaments contacting the nonsolvent liquid flowing over said edge.

16. The process of claim 15 in which said applicator of circular construction is donut-shaped having nonsolvent liquid flowing over at least one of the inner or outer annular surfaces with the pattern of spinneret orifices positioned to direct the extruded filaments over the said edges without contacing one another.

17. The process of claim 1 in which said filaments are passed through an atmosphere containing said nonsolvent liquid particles to deposit the coating of said nonsolvent liquid on the surface of said filaments.

18. The proces of claim 17 in which said filaments have an induced electrical charge to attract particles of nonsolvent liquid onto the surface of said filaments to increase the deposition of said nonsolvent liquid.

19. The process of claim 1 in which the surface of each of said filaments is passed through a substantially vertical tube at substantially the same speed as said nonsolvent liquid is moving therethrough before said filaments are brought together.

20. The process of claim 1 in which a spray of said nonsolvent liquid is applied to the surface of said filaments as the filaments are being extruded.

21. The process of claim 20 in which said spray of nonsolvent liquid is produced by holes positioned in said spinneret head that directs said nonsolvent liquid onto the surface of said filaments.

22. The process of claim 1 in which a foam comprising said nonsolvent liquid and a foamable surfactant is applied to said filaments.

23. The process of claim 1 in which the filaments are passed through a chamber containing a foam comprising said nonsolvent liquid.

24. A method for making a cellulose fiber which comprises spinning into an air space a solution containing cellulose dissolved in a tertiary amine oxide solvent for cellulose, drawing the resulting filaments in air while avoiding mutual contact to orient their molecular structure, wetting the surface of said filaments with a nonsolvent for cellulose which is compatible with said solution to precipitate cellulose only adjacent to the surface of the filaments about a core of said solution, precipitating the cellulose in said core with nonsolvent for the cellulose, and drying the resulting fiber without additional drawing.

25. The process of claims 1, 2, 3, 4, 5, 6, 8, 10, 13, 14, 15, 22, 23 or 24 wherein said air space consists essentially of air.

26. The process of claims 1, 2, 3, 4, 5, 6, 8, 10, 13, 14, 15, 22, 23, or 24 wherein said air space consists essentially of an inert gas.

* * * * *